US007237470B2

(12) United States Patent
Burns, Sr.

(10) Patent No.: US 7,237,470 B2
(45) Date of Patent: Jul. 3, 2007

(54) FLUID POWER UNIT HAVING CLOSED CIRCUIT

(75) Inventor: Patrick J. Burns, Sr., Dallas, TX (US)

(73) Assignee: Burns Controls Company, Dallas, TX (US)

( * ) Notice: Subject to any disclaimer, the term of this patent is extended or adjusted under 35 U.S.C. 154(b) by 0 days.

(21) Appl. No.: 11/176,412

(22) Filed: Jul. 7, 2005

(65) Prior Publication Data

US 2006/0005697 A1 Jan. 12, 2006

Related U.S. Application Data

(60) Provisional application No. 60/586,199, filed on Jul. 8, 2004.

(51) Int. Cl.
*F15B 11/08* (2006.01)

(52) U.S. Cl. ..... 91/306; 417/397; 137/625.6

(58) Field of Classification Search ..... 91/304, 91/305, 306, 308, 309, 313, 318, 323; 417/397, 417/401, 404; 137/625.6
See application file for complete search history.

(56) References Cited

U.S. PATENT DOCUMENTS

| | | | | | |
|---|---|---|---|---|---|
| 217,952 | A | | 7/1879 | Neff | |
| 1,406,330 | A | * | 2/1922 | Barner | 91/306 |
| 2,296,647 | A | | 9/1942 | McCormick | |
| 3,162,093 | A | * | 12/1964 | Zoller | 91/306 |
| 3,282,167 | A | * | 11/1966 | McKenzie | 91/306 |
| 3,555,966 | A | | 1/1971 | Coniglio | |
| 3,780,621 | A | | 12/1973 | Romel | |
| 3,800,665 | A | * | 4/1974 | Von Ruden | 91/305 |
| 3,943,823 | A | * | 3/1976 | Tammy | 91/306 |
| 4,050,356 | A | * | 9/1977 | Jaggi et al. | 91/306 |
| 4,099,450 | A | | 7/1978 | Mase | |
| 4,104,008 | A | * | 8/1978 | Hoffmann et al. | 417/397 |
| 4,280,396 | A | | 7/1981 | Zeuner et al. | |

(Continued)

OTHER PUBLICATIONS

TEXSTEAM Inc., Series 6100, Gas or Air Driven Reciprocating Pumps, Specifications, 1996, 11 pages.

*Primary Examiner*—Igor Kershteyn
(74) *Attorney, Agent, or Firm*—John A. Thomas

(57) ABSTRACT

A fluid power unit has a cylinder in a housing, a piston slidable in the cylinder and dividing the cylinder into a retract side and an extend side, and a two-position control valve. The control valve has a spool and first and second pilots. The position of the spool is responsive to the first and second pilots. There is a retract poppet valve in the retract side of the cylinder, and an extend poppet valve in the extend side. The retract and extend poppet valves are biased to a closed position. The retract poppet valve is in a fluid path between the retract side and the control valve; the extend poppet valve is in a fluid path between the extend side and the control valve. The alternate movement of the piston in the cylinder alternately opens and closes the poppet valves, The circuit connects the poppet valves to the pilots and alternately applies and releases pressure to the pilots, causing the spool of the control valve to shift and apply inlet pressure to the piston on alternate sides. Thus the piston oscillates as long as inlet pressure is applied. All the fluid paths and the poppet valves are fluidly sealed inside the housing, so no gas is vented to the atmosphere.

20 Claims, 4 Drawing Sheets

U.S. PATENT DOCUMENTS 4,846,045 A * 7/1989 Grach et al. ..... 91/306
5,758,862 A 6/1998 Sturman
5,787,786 A 8/1998 Zeuner
6,516,706 B2 2/2003 Porter et al.
6,557,332 B2 5/2003 Rhody

* cited by examiner ( VIEW A-A )

FLUID POWER UNIT HAVING CLOSED CIRCUIT

CLAIM FOR PRIORITY

This application claims the priority of that certain U.S. provisional patent application titled "Adjustable-stroke Fluid Injector," and filed Jul. 8, 2004 under Ser. No. 60/586,199.

TECHNICAL FIELD

The application relates the field of hydraulic or pneumatic power units, particularly those driving pumps intended to inject fluids such as chemicals or lubricants into piping systems. A particular application is in the petroleum production industry. Other applications could include a drive for a shaking mechanism or other devices requiring an oscillating motion.

BACKGROUND

Fluid power units typically drive pumps and injectors in hazardous locations such as oil fields and refineries. The usual practice in the oil field is to drive the power unit with natural gas. It is important not to vent gas from the power unit; for example, hydrogen sulphide is commonly a part of natural gas and is toxic to humans. Also, environmental concerns with emission of greenhouse gasses such as methane compel the reduction of gas venting.

Further, control valves for power units should be directly connected to the power cylinder to avoid breaks in connecting lines; indeed, connecting lines found in prior-art power units should be avoided all together.

There a need for a fluid power-unit having a closed system, where the power unit and its associated control valve do not vent to the outside, either at controlling poppet valves, or exhaust ports, or through leakage through seals made in construction of the units.

SUMMARY

A fluid power unit comprises a cylinder, a piston slidable in the cylinder and dividing the cylinder into a retract side and an extend side, and a two-position control valve. The control valve has a spool and first and second pilots. The position of the spool is responsive to the first and second pilots. There is a retract poppet valve in the retract side of the cylinder, and an extend poppet valve in the extend side. The retract and extend poppet valves are biased to a closed position. The retract poppet valve is in a fluid path between the retract side and the control valve; the extend poppet valve is in a fluid path between the extend side and the control valve, so that, when the spool is in its first position and the retract poppet valve is closed, the spool completes a fluid path, as follows:

from the outlet to the first pilot;

from the inlet to the extend side; and, from the retract side to the outlet.

When the retract side poppet opens it completes a fluid path from the first pilot to the retract side, causing the spool to shift to its second position, so that the spool completes a fluid path, as follows:

from the second pilot to the outlet;

from the inlet to the retract side; and, from the outlet to the extend side.

When the extend side poppet opens, it completes a fluid path from the second pilot to the extend side, causing the spool to shift to its first position. The fluid paths from the inlet to the extend side and the retract side further include a first orifice in the path from the inlet to the first pilot and a second orifice in the path from the inlet to the second, so that the first and second orifices slowly transmit inlet pressure to their respective first and second pilots when the respective retract and extend poppet valves are closed.

Since the force of the moving piston acting on the poppet valves in the retract and extend sides of the cylinder causes the poppet valves to open, the poppet valves will open alternately as the piston moves back and forth. This means that pressure to the control valve pilots will alternate, moving the control valve spool alternately from its first position to its second position. Thus, the piston oscillates.

The cylinder is defined by a housing, and all fluid paths are internal to the housing. The cylinder is a bore in the housing closed by end caps. In the preferred embodiment, the end caps each have a lip for sealing to the bore of the cylinder. This lip is sealed to the bore by a sealing means, such as at least one O-ring.

DRAWINGS

DESCRIPTION

Figure 1B:
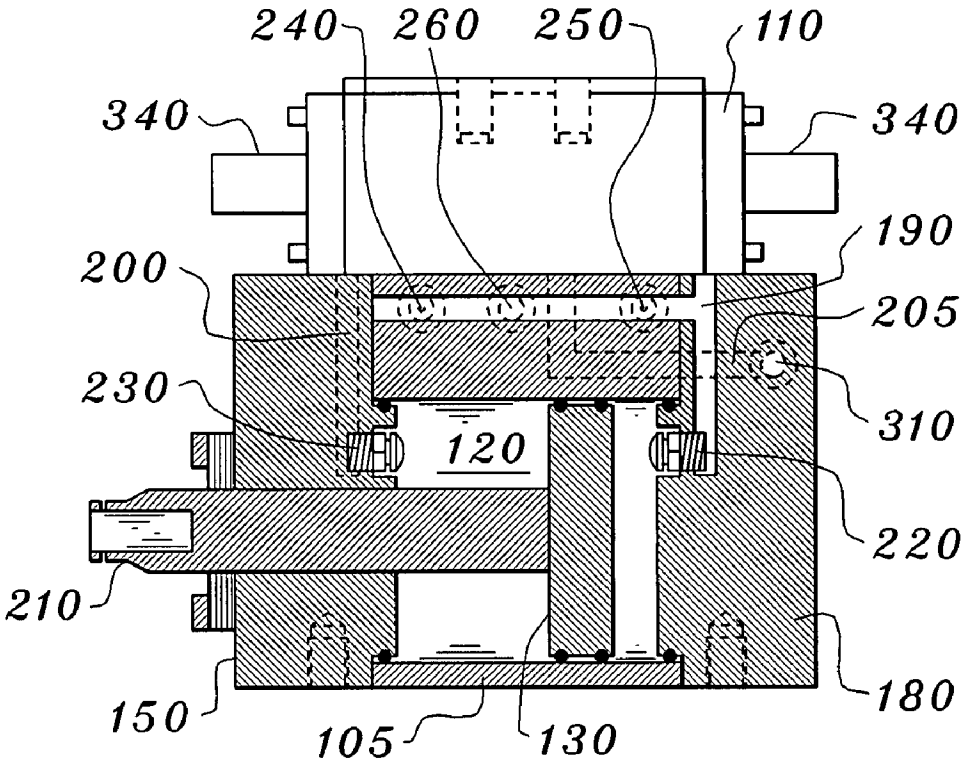
FIG. 1 shows a single-ended pump power unit, in cutaway to display its internal piston and bore.
Figure 1A:
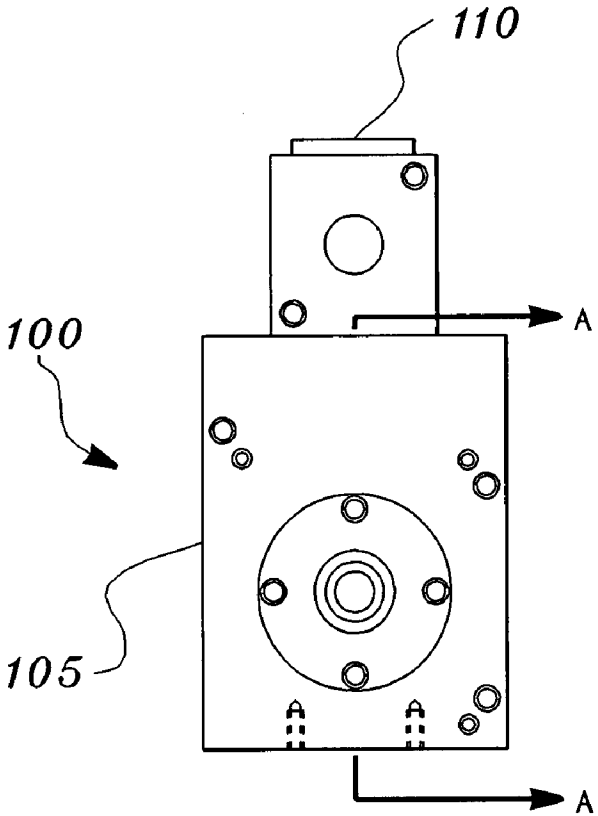

FIG. 1 shows a single-ended pump power unit (100) of the preferred embodiment. The power unit (100) has connected to it a manifold for a control valve (110). The power unit (100) is internally ported inside its housing (105), having no external manifold to mount the control valve (110). The section, FIG. 1B, shows that internally, the power unit (100) has a cylinder (120) and a piston (130). The piston (130) seals within the cylinder (120) by a sealing means, such as O-rings (140). The housing (105) is assembled and closed by an end caps (150, 180) bolted to the housing (105) of the power unit (100). Unlike prior-art designs that use a flat end cap, the end caps (150, 180) of the preferred embodiment have a lip (160) that seats within the cylinder (120), and the lip (160) is sealed to the bore of the cylinder (120) by a sealing means, shown here as second O-rings (170) fitting into grooves in the circumference of the lips (160). The power unit (100) may preferably be constructed with a solid body sealed with two such end caps (150, 180), the lip of the second end cap (180) shown in FIG. 1, with similar sealing means.

In the preferred embodiment, the end caps (150, 180) of the power unit (100) thus seal from the side. This allows high torque to be applied to the fasteners on the end-cap screws without risking leakage from body of power unit (100) through the end-cap (150, 180) seals (170).

The preferred embodiment also has separate bolts to mount the fluid end (320) to the power unit (100), thus making the power unit (100) a sealed unit separate from the fluid end (320)

The housing (105) of the power unit (100) contains all fluid paths or manifolding required for the unit to operate according to the circuit shown in FIG. 2 and discussed below. In FIG. 1B such fluid paths in the power unit (100) are shown lying in different planes, although this is not necessarily required. A first fluid path (190) is shown communicating with the inlet port (260) and first and second removable orifices (240, 250). A second fluid path (200) is shown in dashed outline in communication with the retract poppet valve (220) and the control valve (110). A third fluid path (205) is shown in dashed outline in communication with the outlet port (310). All three fluid paths (190, 200, 205) of course communicate with the control valve (110) according the circuit depicted in FIG. 2. The exact location and layout of the fluid paths in the housing (105) are not important, but all such paths are fluidly sealed within the housing. Such fluid paths may be manufactured by drilling holes in the housing (105).

FIG. 1 shows an output shaft (210) attached to the piston (130) for connecting a load, such as a pump (310), as shown below.

FIG. 1B also shows a retract poppet valve (220) and an extend poppet valve (230), actuated by the movement of the piston (130). First and second removable orifices (250, 260) and covering plugs are provided.

Figure 2A:
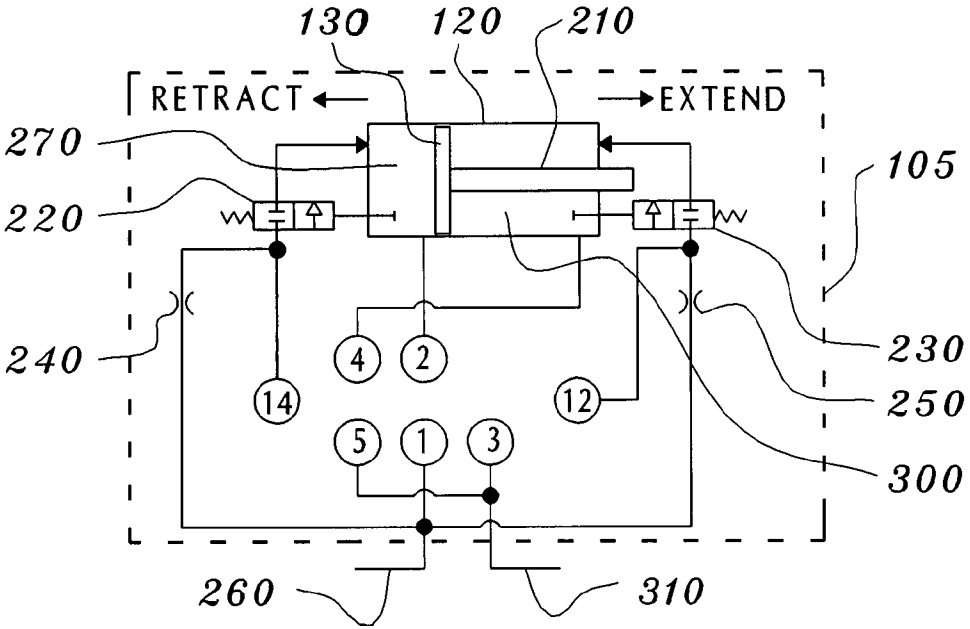
FIG. 2 shows the pneumatic circuit of the preferred embodiment.
Figure 2B:
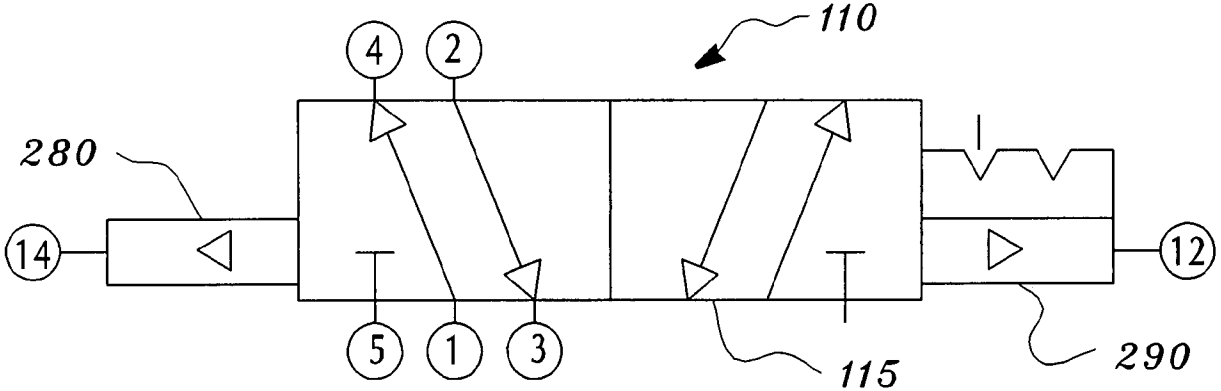

FIG. 2 shows a schematic of the pneumatic circuit for the preferred embodiment. The moveable spool (115) of the control valve (110) is shown schematically in FIG. 2B. In many applications, the power fluid will be natural gas. Other fluids could also be used, as the application may dictate. This application uses the term "gas" to describe all power fluids. The circuit works as follows:

As gas pressure is applied through the inlet port (260) and control valve (110) to the extend side (300) of the cylinder (120), the piston (130) in the cylinder (120) moves to the retracted position. As it retracts, the piston (130) depresses the retract pilot poppet (220). As the retract pilot poppet (220) opens, it dumps the pilot pressure from the first pilot (280) of the control valve (110) into the retract cylinder cavity (270), creating a pressure differential across the spool (115) in control valve (110) This pressure differential causes the control valve spool (115) to shift to its second position, allowing the second pilot (290) to take control. As the spool (115) shifts, inlet pressure is directed to the control valve (110) port numbered "2 " in FIG. 2. This pressure enters the retract side (270) of the cylinder (120) and sends the piston (130) to the extended position. Gas pressure on the extend side (300) of the cylinder (120) escapes through the control valve (110) to the outlet port (310).

Once the piston (130) releases the retract pilot poppet (220), the pilot pressure will slowly rebuild from the inlet pressure through the first orifice (240), equalizing the pressure on both sides of the control valve spool (115). As the piston (130) fully extends it will depress the extend pilot poppet (230). This will release gas into the extend cylinder cavity (300) from the second pilot, allowing the first pilot (280) to take control by creating the unbalanced condition that allows the control valve spool (115) to shift. The spool (115) shifting will redirect the gas pressure to the port numbered "4," causing the piston (130) to move to the retracted position. Gas pressure on the retract side (270) escapes through the outlet port (310).

This cycle is repeated automatically, so the piston (130) oscillates between the extend and retract positions until gas pressure is removed from the inlet port (260). Due to the pilot pressure dumping into the cylinder (120) in the preferred embodiment, no gas is released into the atmosphere. The outlet port (310) can, however, be vented to atmosphere, but in most applications, it would be captured by piping into a lower downstream pressure.

Figure 3:
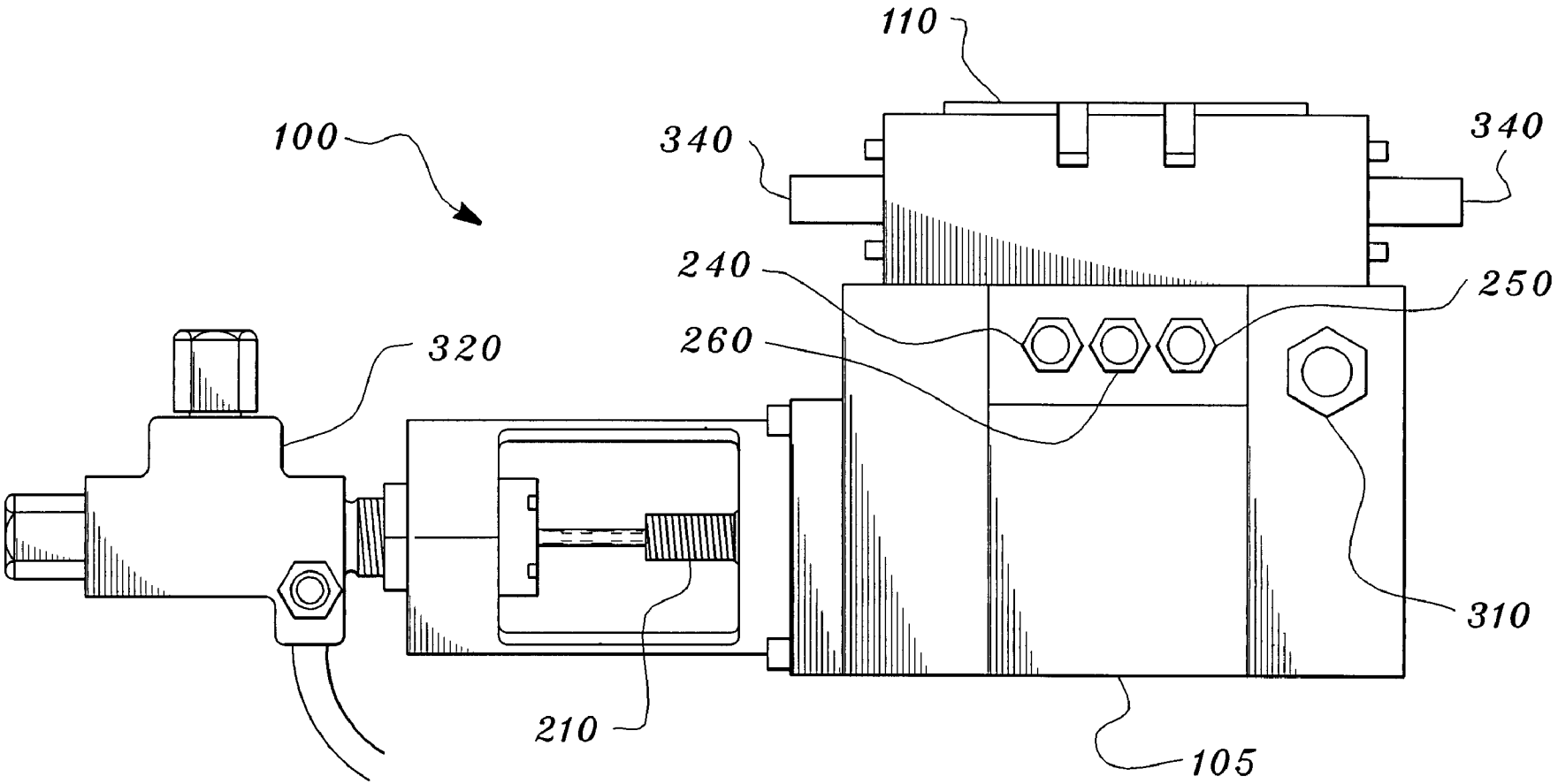
FIG. 3 shows a single-ended pump power unit connected to a pump.

FIG. 3 shows a single-ended pump power unit (100) connected to a pump (320). A pump (320) connected in this manner to a power unit (100) is also called a "fluid end."

Figure 4:
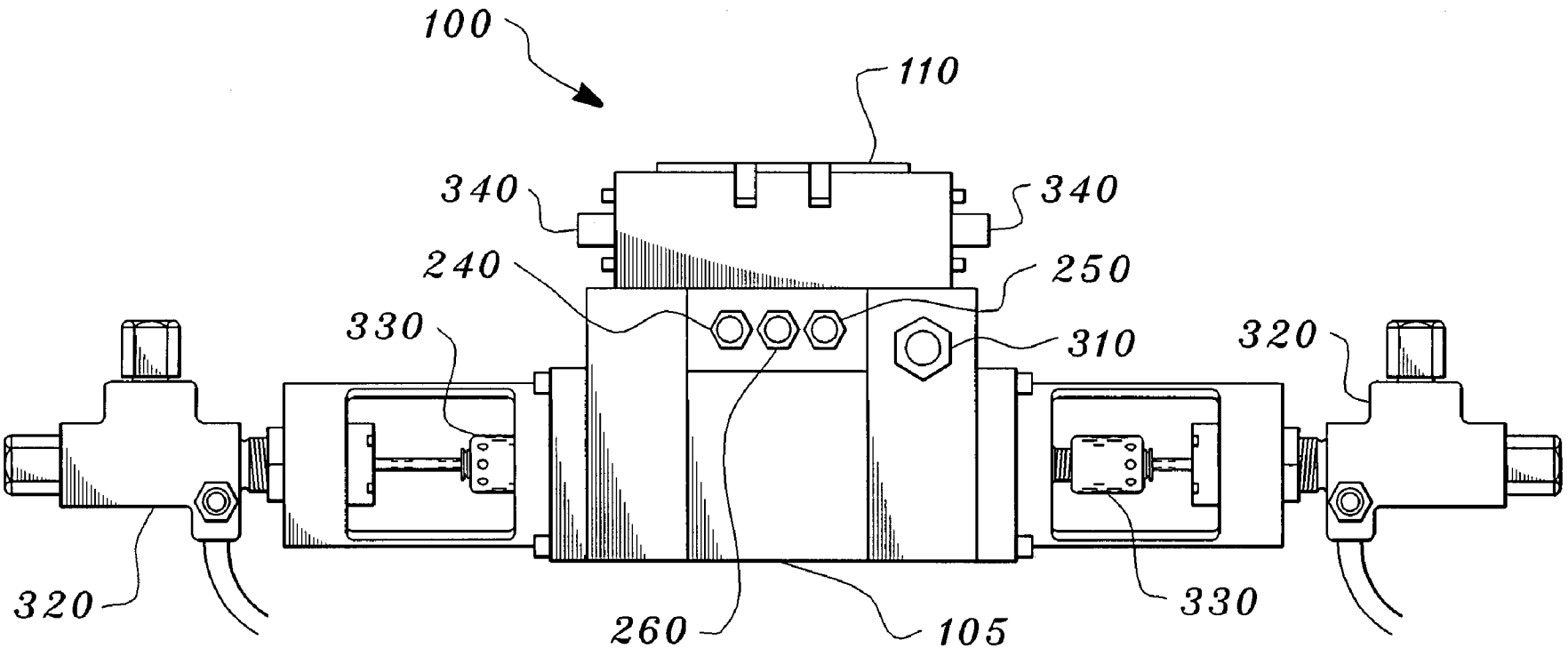
FIG. 4 shows a double-ended pump power unit connected to two pumps, with provision for stroke adjustment.

FIG. 4 is similar to FIG. 3, except that the power unit (100) is driving two opposed pumps (320).

One embodiment may have an adjustable connector (330), allowing the length of the stroke input to the pump (320) to be changed, thus allowing minimum fluid-end output without stalling the gas-driven power unit (100). This is shown in the two-pump example in FIG. 4. Typically, the adjustable connector (330) is threaded onto the output shaft (210) and adjustment of the stroke is made by lengthening or shortening the distance between the power unit (100) and the rod of the pump (310).

Preferably, the power unit (100) has removable poppet valves (220, 230) for ease of maintenance. The poppet valves (220, 230) may be removed by removing the end caps (150, 180). In the preferred embodiment, there is no exhausting of the power unit (100) poppet valves (220, 230); the power unit (100) has only input and output ports (260, 310) that are piped to inlet gas pressure and, preferably in most applications, an outlet return line.

The power unit control valve (110) typically has manual overrides (340) on each side that allow the control valve (110) to be actuated manually without gas.

I claim:

1. A fluid power unit comprising:

an inlet and an outlet;

a cylinder;

a piston slidable in the cylinder, the piston dividing the cylinder into a retract side and an extend side;

a two-position control valve; the control valve having a spool, a first pilot and a second pilot; the position of the spool responsive to the first and second pilots;

a retract poppet valve in the retract side, and an extend poppet valve in the extend side; the retract and extend poppet valves being biased to a closed position;

the retract poppet valve being in a fluid path between the retract side and the control valve;

the extend poppet valve being in a fluid path between the extend side and the control valve; so that, when the spool is in its first position and the retract poppet valve is closed, the spool completes a fluid path:

from the inlet to the extend side; and, from the retract side to the outlet; and, when the retract side poppet valve opens it completes a fluid path from the first pilot to the retract side, causing the spool to shift to its second position, so that the spool completes a fluid path:

from the inlet to the retract side; and, from the outlet to the extend side; and, when the extend side poppet valve opens it completes a fluid path from the second pilot to the extend side, causing the spool to shift to its first position; and, a first orifice in the path from the inlet to the first pilot, and a second orifice in the path from the inlet to the second pilot, so that the first and second orifices transmit inlet pressure to their respective first and second pilots when the respective retract and extend poppet valves are closed.

2. The fluid power unit of claim 1, where the retract and extend side poppets are opened by the force of the piston.

3. The fluid power unit of claim 1, where the piston has a shaft.

4. The fluid power unit of claim 3, where a fluid end is connected to the shaft.

5. The fluid power unit of claim 1, where the piston has a first shaft on the extend side of the piston and a second shaft on the retract side of the piston.

6. The fluid power unit of claim 5 where a fluid end is connected to each of the first and second shafts.

7. The fluid power unit of claim 1 where the cylinder is defined by a housing.

8. The fluid power unit of claim 7 where all fluid paths are internal to the housing.

9. The fluid power unit of claim 7 where the housing further comprises end caps; the end caps each having a lip for sealing to the bore of the cylinder.

10. The fluid power unit of claim 9 where the lip for sealing the end caps to the bore of the cylinder further comprises at least one O-ring.

11. A fluid circuit for a fluid power unit, the circuit comprising:

an inlet for fluid pressure and an outlet for fluid pressure;

a two-position, four-way control valve; the control valve further comprising:

first and second pilot ports; and, first and second control inlets;

a cylinder having a piston slidable in the cylinder; the piston dividing the cylinder into a retract side and an extend side;

a retract poppet valve actuated by movement of the piston to the retract side;

an extend poppet valve actuated by movement of the piston to the extend side;

a first and second orifice;

the retract and extend poppet valves being biased to a closed position;

the retract poppet valve connected between the retract side and the first pilot port;

the first orifice connected between the first pilot port and the inlet;

the extend poppet valve connected between the extend side and the second pilot port;

the second orifice connected between the second pilot port and the inlet;

the control valve connected to the inlet and outlet so that in its first position the inlet is connected to the extend side, the outlet is connected to the retract side, and the first control inlet is connected to the outlet; and, so that in second position of the control valve, the inlet is connected to the retract side, the outlet is connected to the extend side, and the second control inlet is connected to the outlet.

12. A fluid power unit comprising:

a housing; the housing defining a cylinder;

a piston slidable in the cylinder; the piston dividing the cylinder into a retract side and an extend side;

a two-position control valve; the control valve having a spool and a first pilot and a second pilot; the position of the spool responsive to the first and second pilots;

a retract poppet valve in the retract side;

an extend poppet valve in the extend side;

the retract and extend poppet valves being biased to a closed position;

the retract poppet valve being in a fluid path between the retract side and the control valve;

the extend poppet valve being in a fluid path between the extend side and the control valve;

where all the fluid paths and the poppet valves are fluidly sealed inside the housing.

13. The fluid power unit of claim 12, where the retract and extend side poppets are opened by the force of the piston.

14. The fluid power unit of claim 12, where the piston has a shaft.

15. The fluid power unit of claim 14, where a fluid end is connected to the shaft.

16. The fluid power unit of claim 12, where the piston has a first shaft on the extend side of the piston and a second shaft on the retract side of the piston.

17. The fluid power unit of claim 15 where a fluid end is connected to each of the first and second shafts.

18. The fluid power unit of claim 12 where the housing further comprises end caps; the end caps each having a lip for sealing to the bore of the cylinder.

19. The fluid power unit of claim 18 where the lip for sealing the end caps to the bore of the cylinder further comprises at least one O-ring.

20. The fluid power unit of claim 12 where the fluid paths from the inlet to the extend side and the retract side further include a first orifice in the path from the inlet to the first pilot and a second orifice in the path from the inlet to the second, so that the first and second orifices transmit inlet pressure to their respective first and second pilots when the respective retract and extend poppet valves are closed.

* * * * *